US007871338B2

(12) United States Patent
Nakano

(10) Patent No.: US 7,871,338 B2
(45) Date of Patent: Jan. 18, 2011

(54) GOLF CLUB HEAD

(75) Inventor: Takashi Nakano, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 56 days.

(21) Appl. No.: 12/255,813

(22) Filed: Oct. 22, 2008

(65) Prior Publication Data

US 2009/0137339 A1 May 28, 2009

(30) Foreign Application Priority Data

Nov. 26, 2007 (JP) ..... 2007-304729

(51) Int. Cl.
*A63B 53/04* (2006.01)

(52) U.S. Cl. ..... 473/332; 473/342; 473/350

(58) Field of Classification Search ..... 473/324–350, 473/287–292
See application file for complete search history.

(56) References Cited

U.S. PATENT DOCUMENTS 2,034,936 A * 3/1936 Barnhart ..... 473/329
5,586,947 A * 12/1996 Hutin ..... 473/324
5,697,855 A * 12/1997 Aizawa ..... 473/350
6,431,995 B1 * 8/2002 Jackson ..... 473/305
6,743,114 B2 * 6/2004 Best ..... 473/291
7,207,899 B2 * 4/2007 Imamoto ..... 473/332
7,316,623 B2 * 1/2008 Imamoto ..... 473/332
7,367,898 B2 * 5/2008 Hawkins et al. ..... 473/329
7,575,523 B2 * 8/2009 Yokota ..... 473/332
7,713,141 B2 * 5/2010 Yamamoto ..... 473/332
2007/0129165 A1 6/2007 Matsunaga et al.

FOREIGN PATENT DOCUMENTS

JP 2006-129936 A 5/2006

* cited by examiner

*Primary Examiner*—Sebastiano Passaniti
(74) *Attorney, Agent, or Firm*—Birch, Stewart, Kolasch & Birch, LLP

(57) ABSTRACT

A golf club head comprises a head main body made of a metal material and having a club face for striking a ball, and a vibration absorber made of a viscoelastic material and attached to the head main body. The vibration absorber is provided with a cut having a width of not more than 1.0 mm. Preferably, the cut is substantially parallel with the club face, and the surface at which the cut is opened, comes into contact with the head main body.

6 Claims, 10 Drawing Sheets

GOLF CLUB HEAD

BACKGROUND OF THE INVENTION

The present invention relates to a golf club head provided with a vibration absorber capable of absorbing unpleasant vibrations on off-center hits, without absorbing agreeable vibrations on on-center hits.

In the Japanese Patent Application Publication No. 2006-129936A, there is disclosed an iron-type golf club head composed of a face member and a main body between which a shock absorber made of an elastic material is disposed in order to improve the impact feeling.

In the U.S. Patent Application Publication NO. 2007-129165-A1, there is disclosed a golf club head provided with a vibration absorber in order to absorb vibration of a golf club head at impact, wherein the absorber is made of a first visco-elastic material and a second visco-elastic material whose loss coefficient (loss tangent) has a different temperature dependency than that of the first visco-elastic material so as to cover a wide frequency range of the vibrations.

On the other hand, it is empirically well known to the golfers that, in the case of good shots such that the ball is hit at the sweet spot of the club face (namely, on-center hit), the player feels solid agreeable vibration at the hands through the grip, but in the case of miss shots such that the ball is hit off the sweet spot (namely, off-center hit), the player feels dull unpleasant vibration and sometimes numbness at the hands.

Thus, the vibration include the agreeable vibrations on on-center hits, and the unpleasant vibrations on off-center hits.

From various test results, it was confirmed that the vibrations on on-center hits are higher in the frequency and smaller in the amplitude than the vibrations on off-center hits.

Therefore, if a plurality of visco-elastic materials different in the loss coefficient are used in one golf club head in order to absolve vibrations of a wide frequency range, then not only the unpleasant vibrations on off-center hits but also the agreeable vibrations on on-center hits are absorbed. Therefore, the impact feeling is blurred and considered as being not good for advanced golfers in particular, and as a result, the golf club head is felt by the player as being difficult to control the ball.

The present inventor studied and discovered that, if a visco-elastic material is provided with a narrow cut, then by changing the direction of the cut, the vibration absorbing power is also changed, and it is possible to discriminate the relatively low frequency, relatively large amplitude vibration on miss shots from the relatively high frequency, relatively small amplitude vibration on good shots.

It is therefore, an object of the present invention to provide a golf club head, in which, by providing a vibration absorber with a narrow cut, unpleasant vibrations on miss shots are effectively absorbed while keeping pleasant vibrations on good shots as much as possible, and thereby the impact feeling is prevented from becoming blurred so that the head can provide good impact feeling.

According to the present invention, a golf club head comprises a head main body made of a metal material and having a club face for striking a ball, and a vibration absorber made of a viscoelastic material and attached to the head main body, wherein the vibration absorber is provided with a cut having a width of not more than 1.0 mm.

Preferably, the cut is substantially parallel with the club face, and the surface at which the cut is opened, comes into contact with the head main body.

Therefore, when the vibration on miss shots, which is a relatively low frequency, relatively large amplitude vibration is applied, the nearby portions on both sides of the cut are moved, changing the positive width therebetween or causing friction between the contacting surfaces in the case of zero width. As a result, the vibration energy is transformed into heat, and the vibration is absorbed or damped effectively.

On the contrary, when the vibration on good shots, which is a relatively high frequency, relatively small amplitude vibration is applied, the nearby portions on both sides of the cut are not so moved, thus the vibration energy is not so absorbed. As a result, the head can provide a good impact feeling on good shots and miss shots.

In the following description, the dimensions, positions and directions refer to those under the standard state of the club head unless otherwise noted. Here, the standard state of the club head 1 is such that the club head is set on a horizontal plane HP so that the axis CL of the club shaft(not shown) is inclined at the lie angle (alpha) while keeping the axis on a vertical plane, and the club face F forms its loft angle (beta) with respect to the horizontal plane HP. Incidentally, in the case of the club head alone, the center line of the shaft inserting hole 6*a* can be used instead of the axis of the club shaft.

"Sweet spot SS" is the point of intersection between the club face F and a straight line N drawn normally to the club face F passing the center of gravity G of the head.

"Back-and-forth direction" is a direction parallel with the straight line N projected on the horizontal plane HP.

"Heel-and-toe direction" is a direction perpendicular to the back-and-forth direction and parallel with the horizontal plane HP.

"Up-and-down direction" is a direction perpendicular to the horizontal plane HP.

DESCRIPTION OF THE PREFERRED EMBODIMENTS

Figure 1:
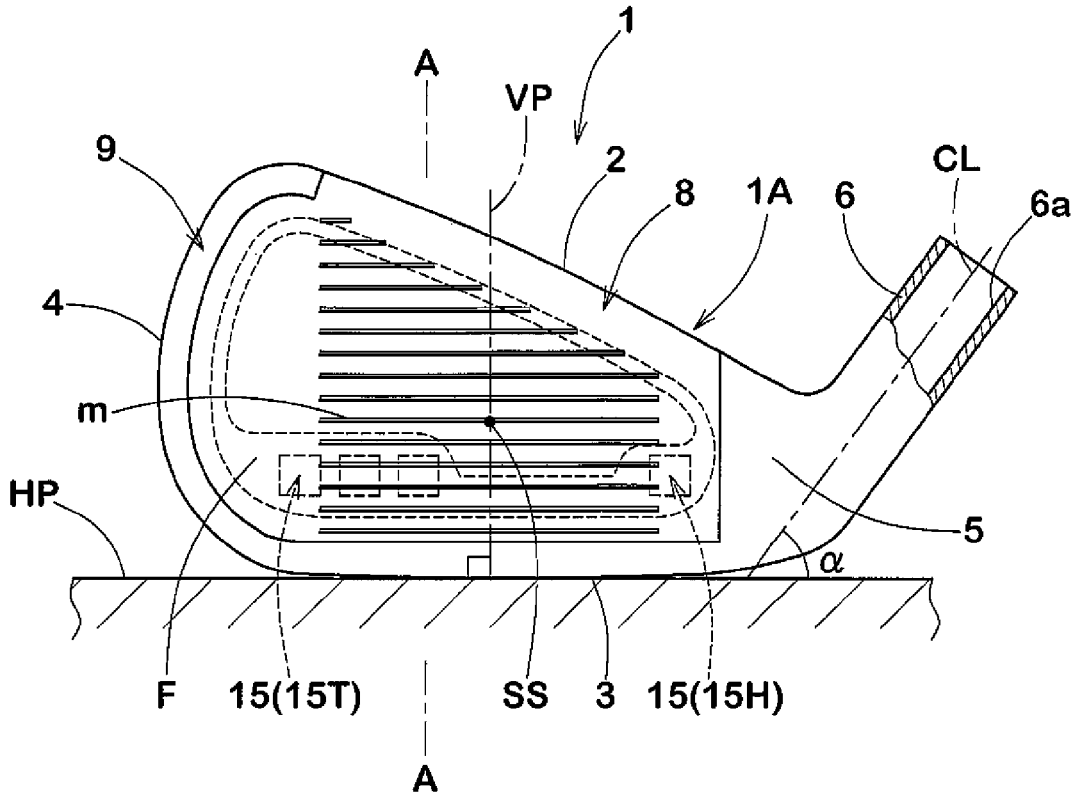
FIG. 1 is a front view of an iron-type golf club head according to the present invention.
Figure 2:
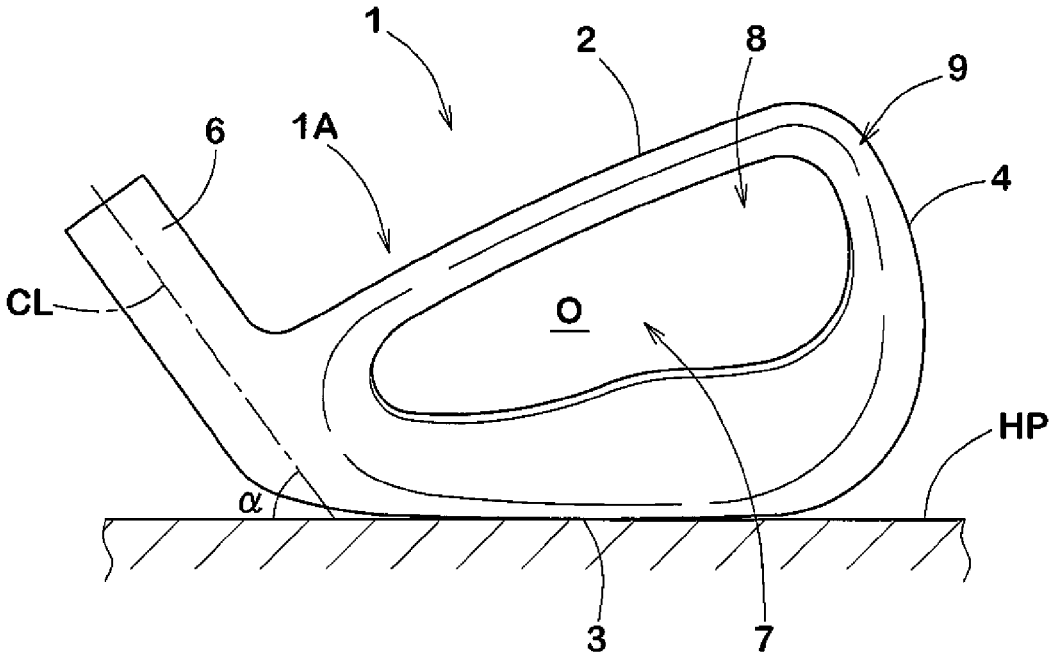
FIG. 2 is a rear view thereof.

Embodiments of present invention will now be described in detail in conjunction with accompanying drawings.

In the drawings, golf club head 1 according to the present invention comprises a head main body 1A and a vibration absorber 15.

The head main body 1A has a club face F for striking a ball, a top portion 2 intersecting the club face F at the upper edge thereof, a sole portion 3 intersecting the club face F at the lower edge thereof, a toe portion 4 extending between the sole portion 3 and the top portion 2 on the toe-side, a heel portion 5 extending between the sole portion 3 and the top portion 2 on the heel-side, and a hosel portion 6 attached to the heel portion 5.

The head main body 1A is composed of a face member 8 and a main frame 9.

The face member 8 is a plate made of a metal material. For example, pure titanium, titanium alloys, aluminum alloys, maraging steels (e.g. SUS450) and the like can be used as the metal material of the face member 8. In this embodiment, a titanium alloy is used.

Figure 3:
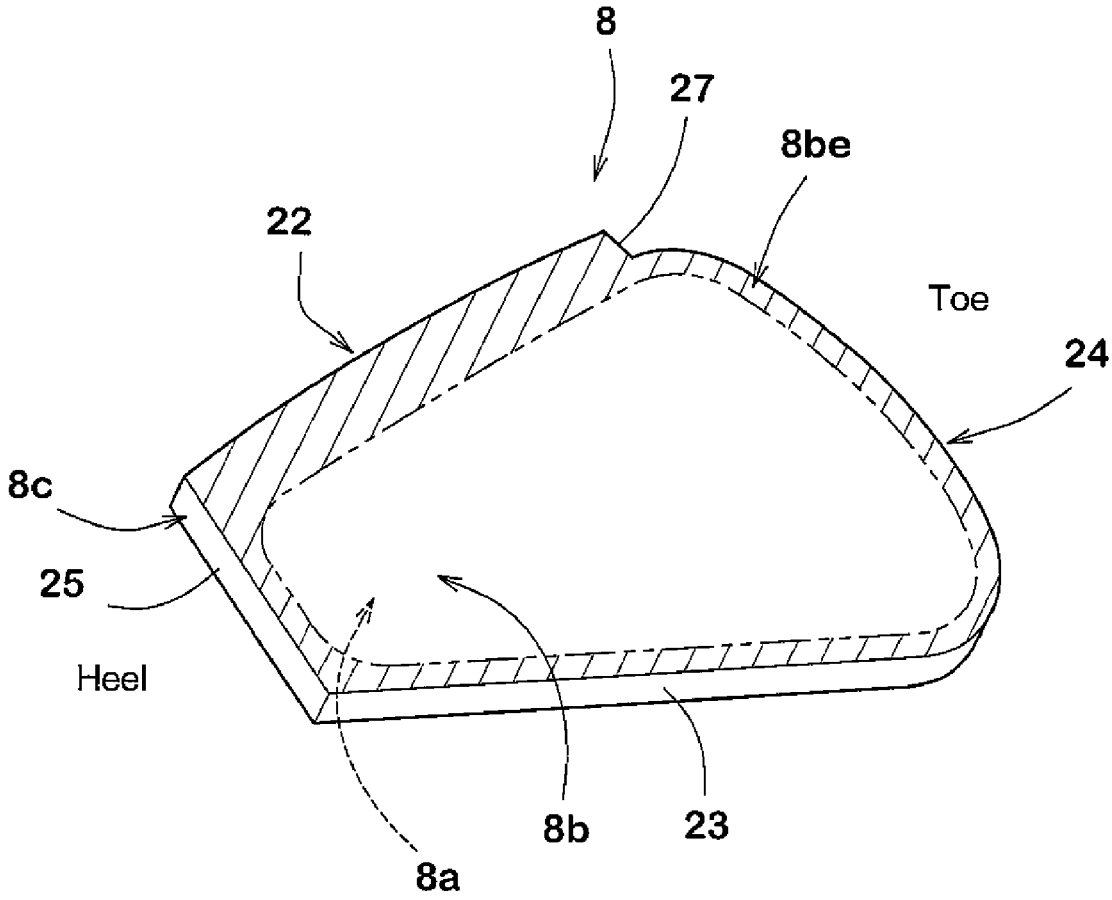
FIG. 3 is a perspective rear view of the face member.

As shown in FIG. 3, the face member 8 has a front surface Sa forming a major part of the club face F, a back surface 8*b* opposite thereto, and an outer peripheral surface 8*c* between the front surface 8*a* and back surface 8*b*.

The front surface 8*a* is substantially flat, excepting grooves or the like provided as impact area markings (m).

The outer peripheral surface 8*c* comprises: a top surface 22 extending along the top portion 2; a bottom surface 23 extending along the sole portion 3; a toe-side surface 24 extending along the toe portion 4; and a heel-side surface 25 extending vertically along the heel portion 5.

In this embodiment, a step 27 is formed between the top surface 22 and the toe-side surface 24, and the top surface 22 deifies a part of the outer surface of the club head in the top portion 2.

The height of the face member 8 gradually increases from the heel towards the toe.

The thickness t1 of the face member 8 is preferably not less than 2.0 mm, more preferably not less than 2.2 mm in view of the durability. But, in view of the rebound performance, the thickness t1 is preferably not more than 3.5 mm, more preferably not more than 3.3 mm. In this embodiment, the thickness t1 is substantially constant, but it is also possible that the face member 8 has a variable thickness t1.

The main frame 9 is made of a metal material which preferably has a larger specific gravity than the face member 8 For example, stainless steels, e.g. SUS630, SUS255, SUS450 and the like can be suitably used. Thereby, the weight is shifted towards the peripheral part of the face member 8 to increase the moment of inertia and the sweet spot area. In this embodiment, the main frame 9 is formed by casting of the metal material.

Figure 4:
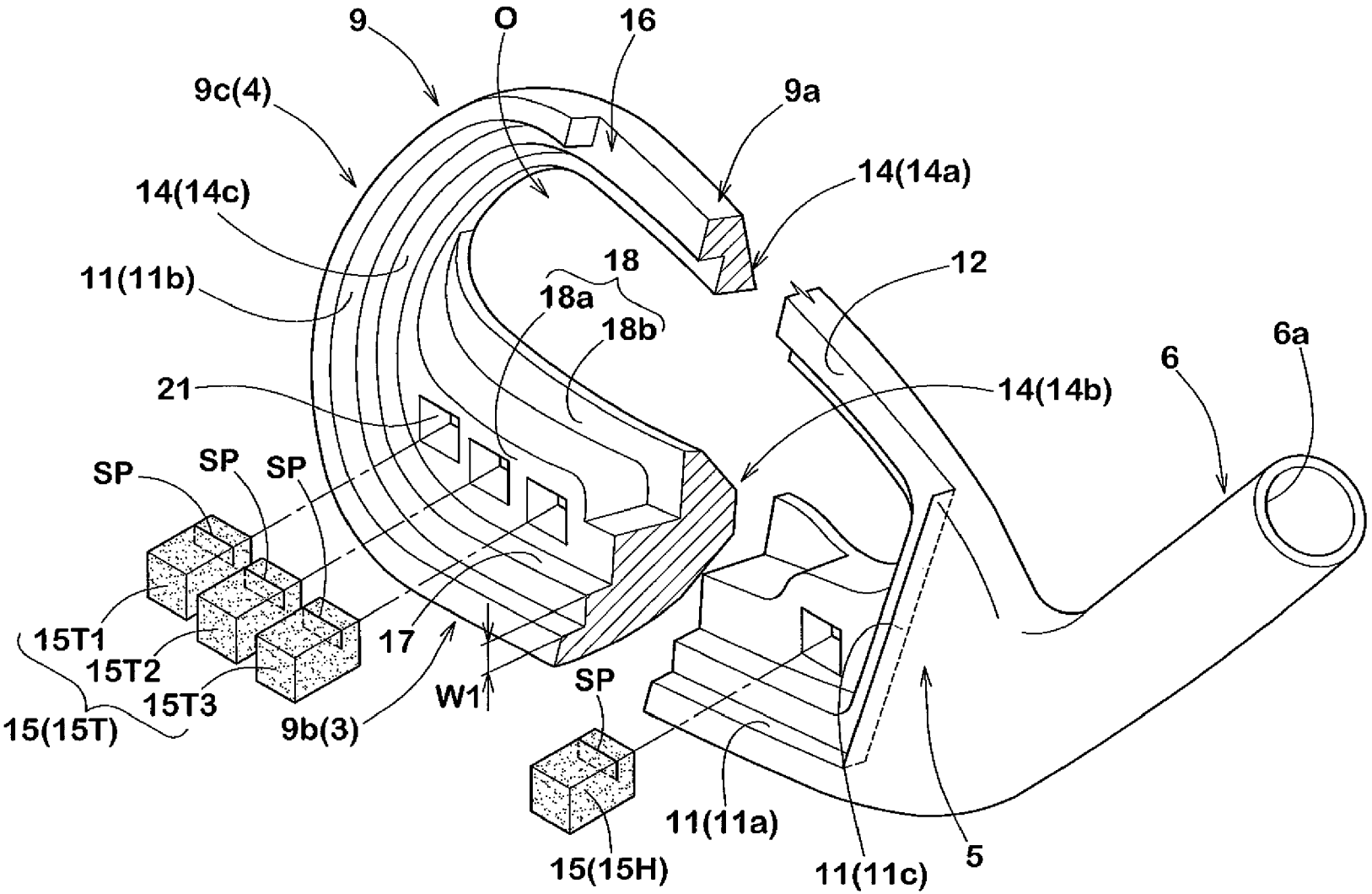
FIG. 4 is an exploded perspective front view of the main frame and the vibration absorbers.
Figure 5:
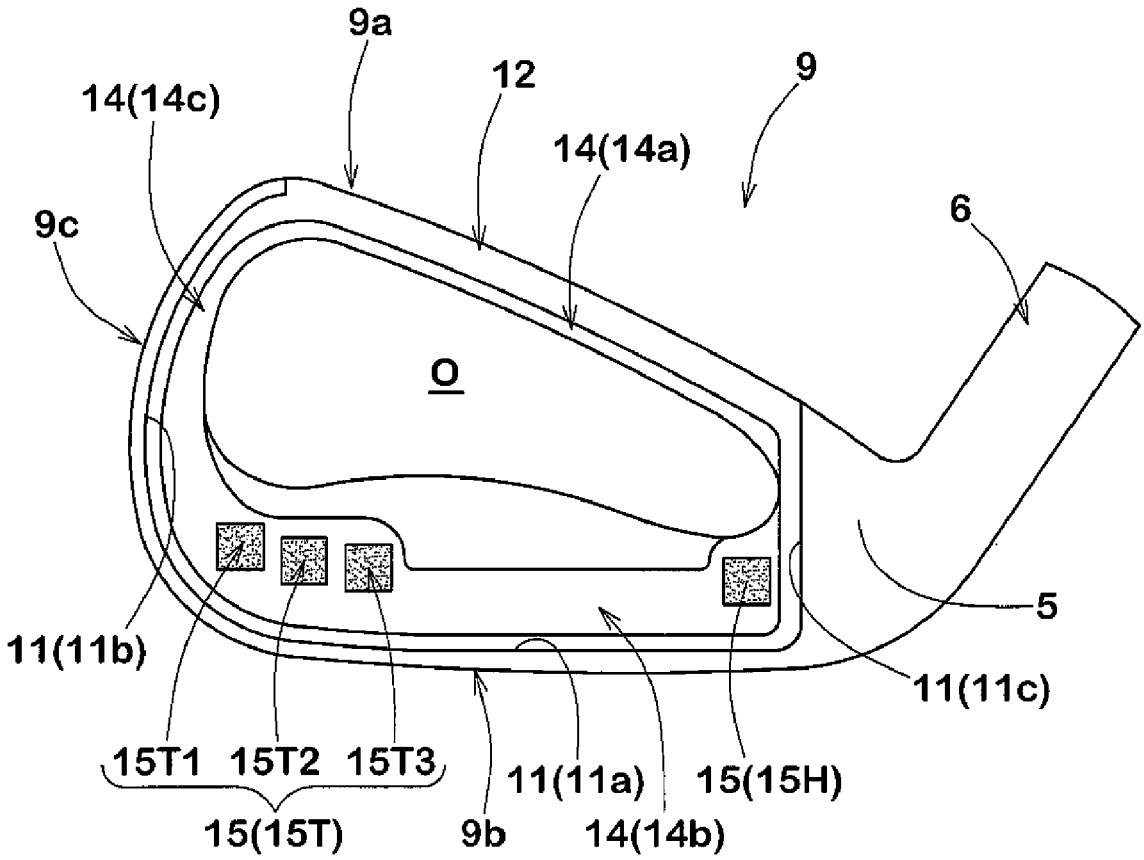
FIG. 5 is a front view of the main frame and the vibration absorbers.

AS shown in FIGS. 3, 4 and 5, the main frame 9 comprises: an upper frame 9*a* extending along the top portion 2; a lower frame 9*b* forming the entirety of the sole portion 3; a toe-side frame 9*c* forming the entirety of the toe portion 4; and a heel-side frame 9*d* forming the entirety of the heel portion 5 and the hosel portion 6, whereby an opening (O) or through-hole surrounded by these frames is formed.

In order to receive the face member 8, the main frame 9 is provided with: an inside peripheral surface 11 contacting and supporting the outer peripheral surface 8*c* of the face member 8; and a receiving surface 12 contacting and supporting the peripheral part 8*be* of the back surface 8*b*. The peripheral part 8*be* is indicated in FIG. 3 by hatching.

The receiving surface 12 is formed circularly, running through the upper frame 9*a*, lower frame 9*b*, toe-side frame 9*c* and heel-side frame 9*d*, so as to support the peripheral part 8*be* of the back surface 8*b*. The receiving surface 12 is located backwards from the club face F by an amount substantially equal to the thickness t1 of the face member 8. In this embodiment, the receiving surface 12 is flat and substantially parallel with the back surface 8*b*.

The inside peripheral surface 11 comprises: a sole-side surface 11*a* of the lower frame 9*b* for supporting the bottom surface 23 of the face member 8; a toe-side surface 11*b* of the toe-side frame 9*c* for supporting the toe-side surface 24 of the face member 8; and a heel-side surface 11*c* of the heel portion 5 for supporting the heel-side surface 25 of the face member 8. The inside peripheral surface 11 has a substantially constant width corresponding to the thickness of the face member 8 at the side surface 23, 24 and 25.

The upper frame 9*a* is not provided with such inside peripheral surface 11 because the part 16 corresponding thereto is removed as described above. Therefore, through this removed part 16, at least a part of the top surface 22 of the face member 8 is exposed, therefore, the face member 8 forms a front part of the top portion 2, and the rear part of the top portion 2 is formed by the upper frame 9*a*. This structure helps to lower the center of gravity G of the head because of the smaller specific gravity of the face member 8.

Thus, the inside peripheral surface 11 and receiving surface 12 of the main frame 9 secure the corner between the back surface 8*b* and the outer peripheral surface 8*c* of the face member 8.

According to the present invention, it is not always necessary to provide the removed part 16. Thus, the inside peripheral surface 11 can be formed continuously around the opening O. Further, it may be also possible to omit the inside peripheral surface 11 entirely so that the face member 8 contacts with and is supported by the receiving surface 12 only.

If the width W1 of the receiving surface 12 is too narrow, it becomes difficult to ensure the durability in the junction between the face member 8 and main frame 9. If too wide contrary, there is a possibility that the rebound performance decreases. Therefore, the width WI of the receiving surface 12 is preferably not less than 0.5 mm, more preferably not less than 1.0 mm, but not more than 5.0 mm, more preferably not more than 3.0 mm, still more preferably not more than 2.0 mm.

The head main body 1A further includes a rear wall 14.

The rear wall 14 extends from the frames 9*a*, 9*c*, 9*b* and 9*d* towards the center of the head, while leaving a space 13 between the rear wall 14 and the back surface 8*b* and terminates. Thus, the rear wall 14 includes: a rear wall 14*a* disposed on the upper frame 9*a*; a rear wall 14*b* on the lower frame 9*b*; and a rear wall 14*c* on the toe-side frame 9*c*, which are formed continuously and have a opposing surface 18 oppositely opposed to the back surface 8*b*.

In the lower rear wall 14*b* in this embodiment, the opposing surface 18 is provided with a step, and thereby the opposing surface 18 is divided into a first opposing surface 18*a* on the club face side and a second opposing surface 18*b* on the rear side. In the other rear walls 14*a* and 14*c*, such step is not provided, therefore, the opposing surface 18 is the same level as the first opposing surface 18*a*. The opposing surfaces 18, 18*a* and 18*b* are substantially parallel with the back surface 8*b*.

Figure 6:
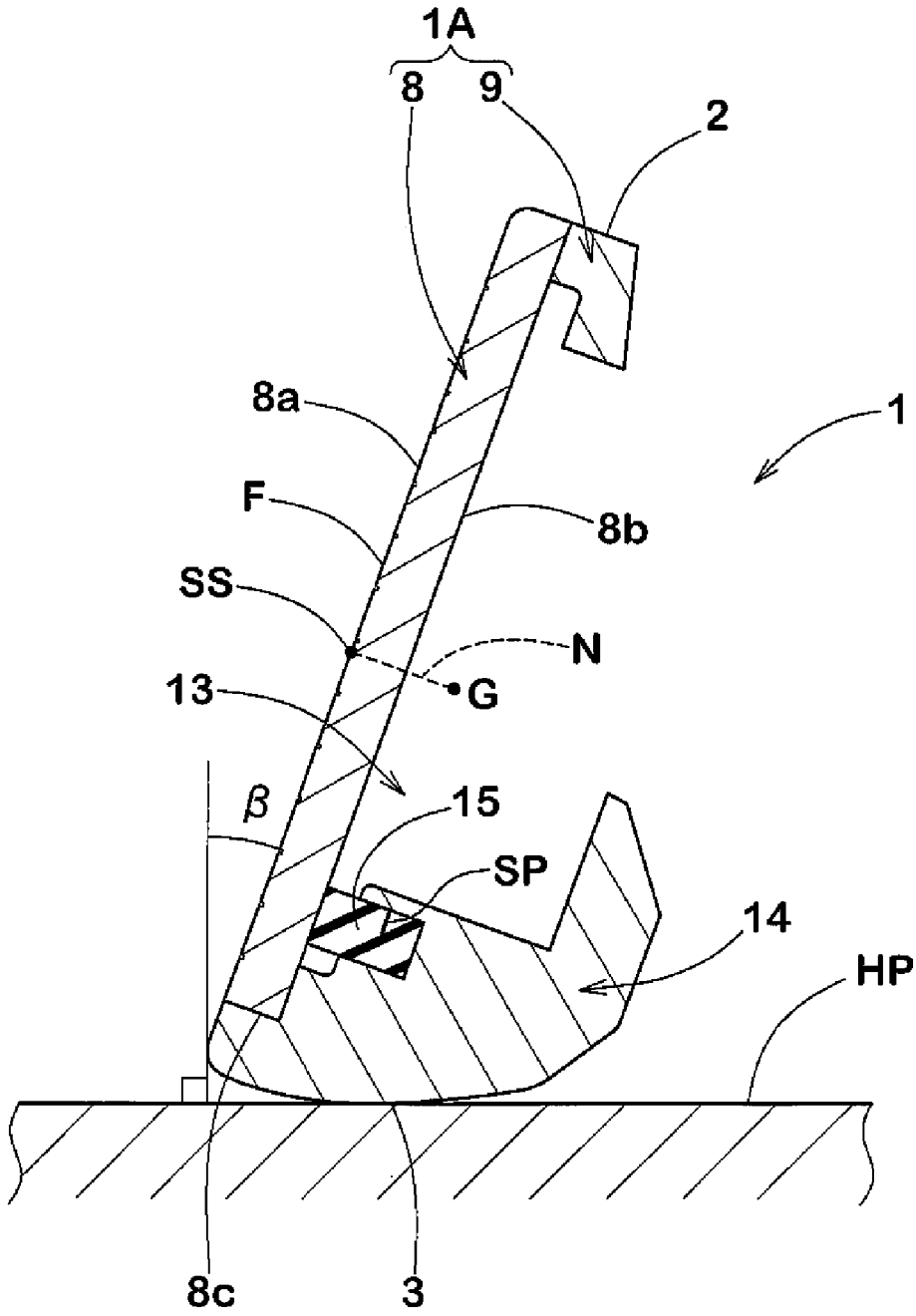
FIG. 6 is a cross sectional view taken along line A-A of FIG. 1.
Figure 7:
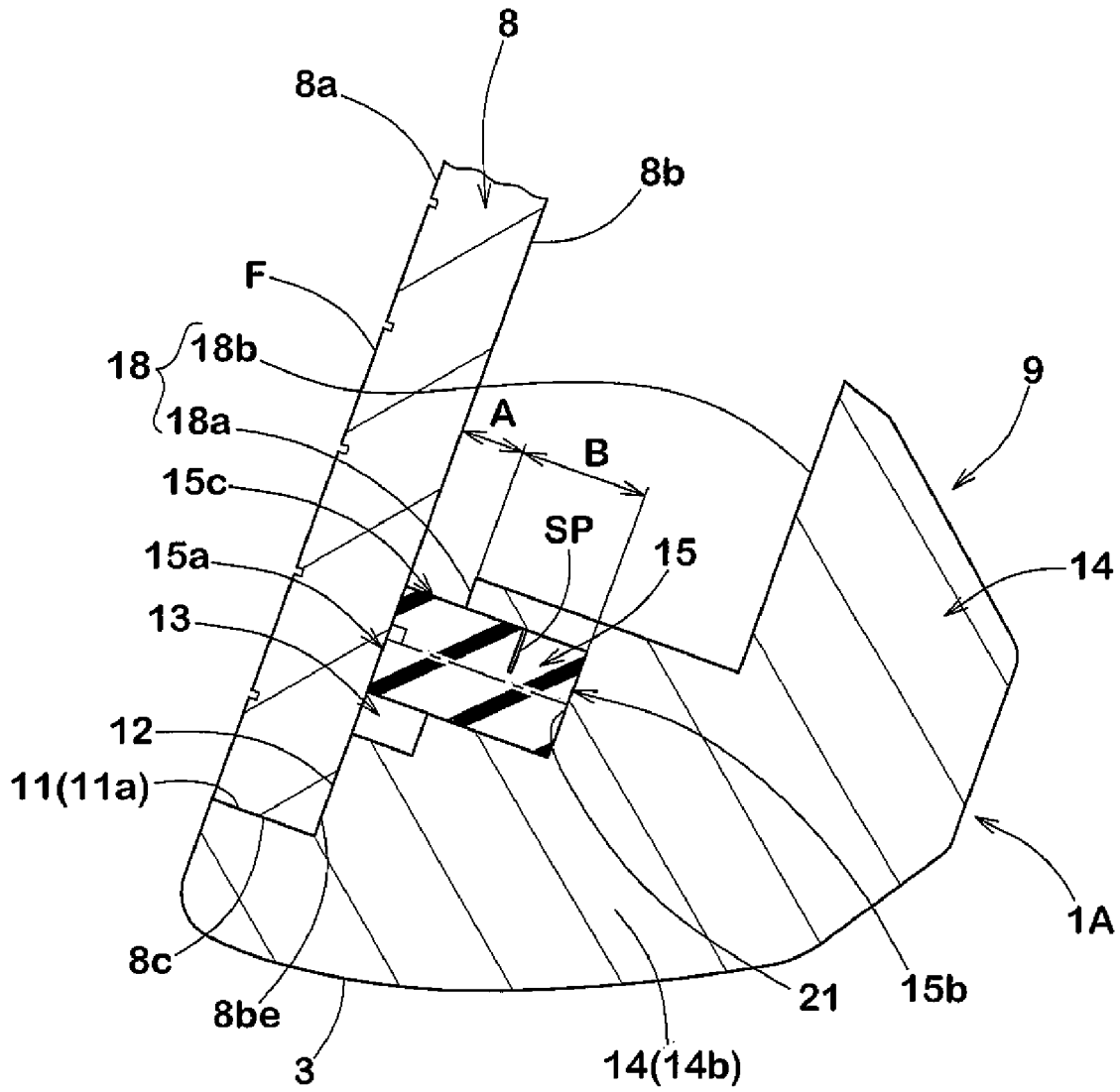
FIG. 7 is an enlarged cross sectional view showing a lower part of the head.

In the embodiment shown in FIG. 6 and FIG. 7, the vibration absorbers 15 are disposed in the space 13 between the back surface 8*b* and the rear wall 14*b* on the lower frame 9*b*.

Figure 8:
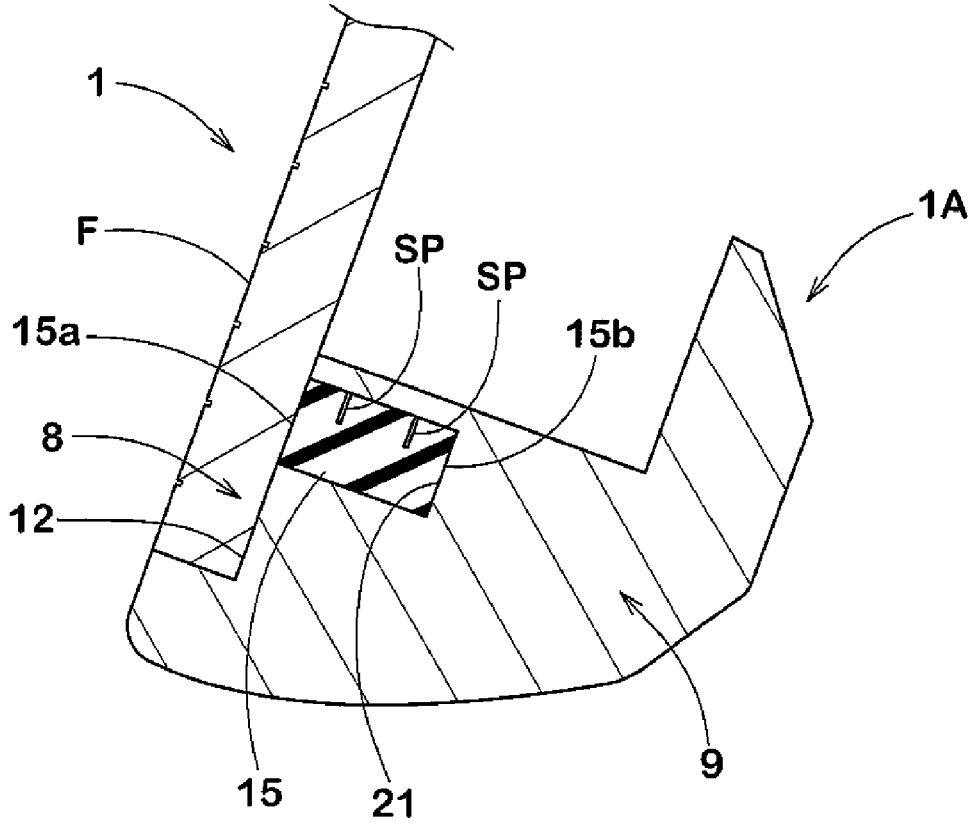
FIG. 8 is an enlarged cross sectional view of a lower part of another embodiment.

In the embodiment shown in FIG. 8, the vibration absorbers 15 are disposed within the lower frame 9*b*.

Figure 9:
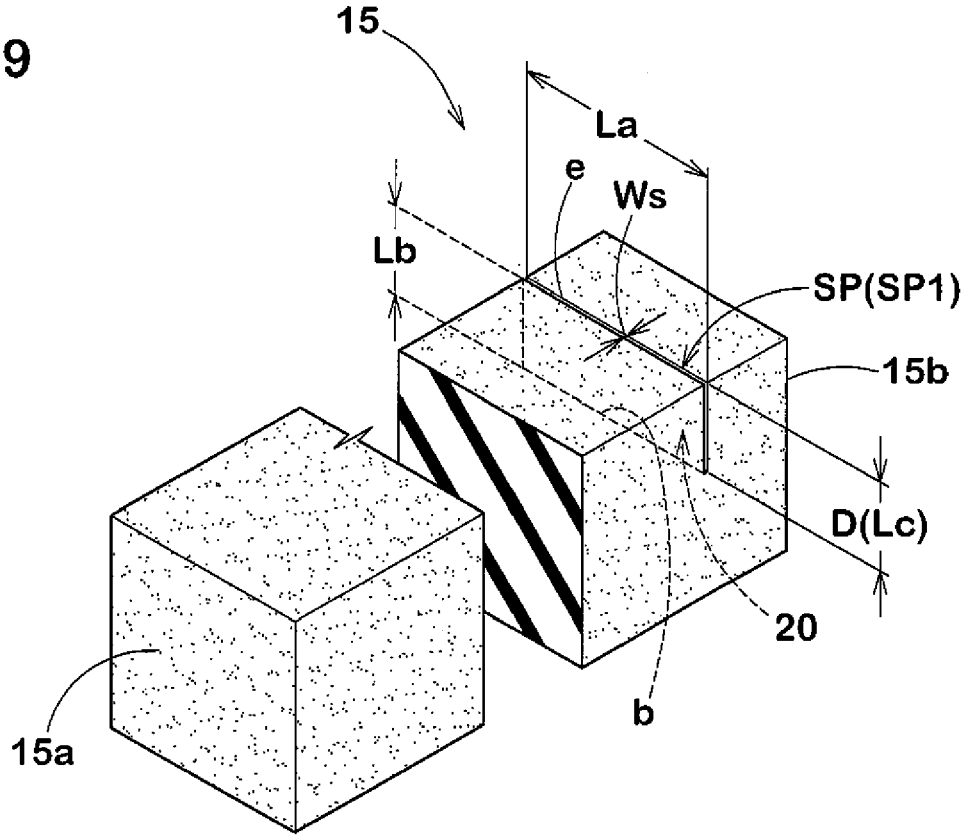
FIGS. 9, 10 and 11 are perspective views showing examples of the vibration absorber.
Figure 10:
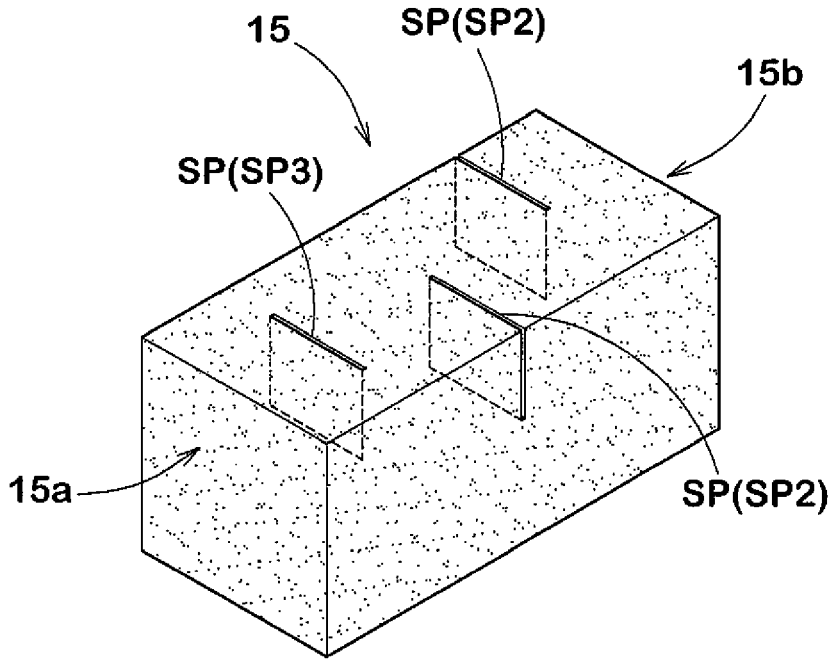
Figure 11:
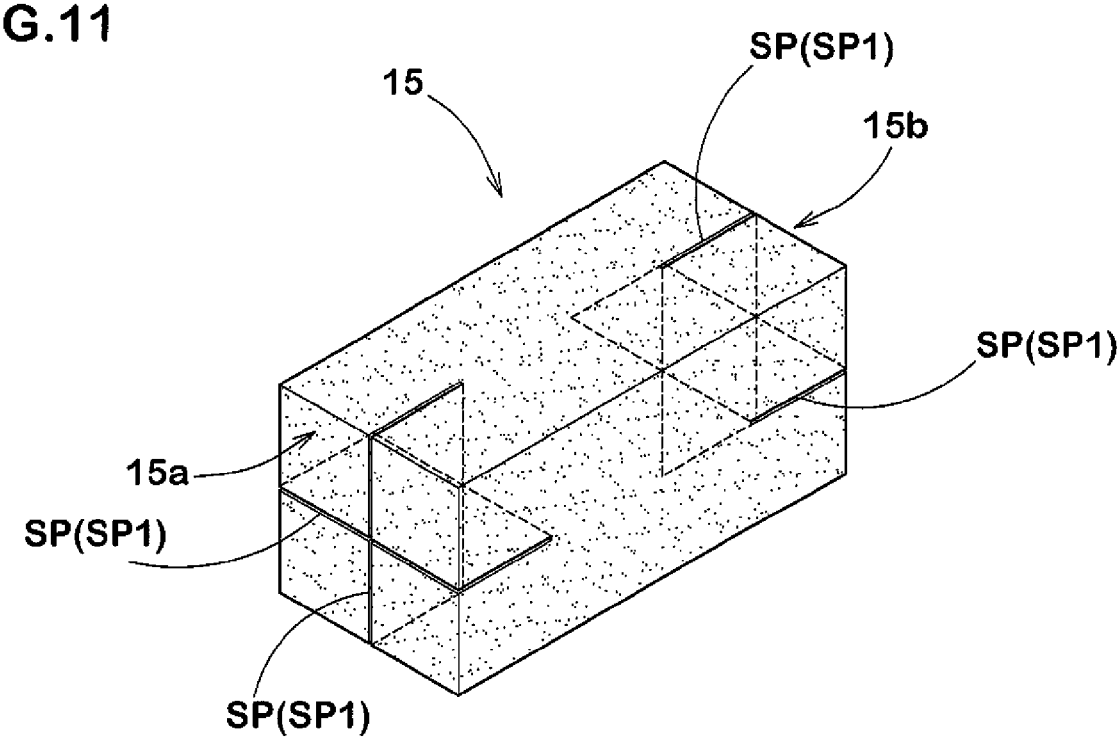

In any case, the front end 15*a* of each of the vibration absorbers 15 comes into contact with the back surface 8*b*, and each of the vibration absorbers 15 is provided with at least one cut SP extending from the surface to a certain depth as shown in FIG. 9, FIG. 10, FIG. 11.

In order to secure the vibration absorbers 15, the head main body 1A is provided with recesses 21. The shape of the recesses 21 is the same as that of the vibration absorber 15 so that the entire surface of the recesses 21 can closely contact with the inserted part of the absorber 15.

For the vibration absorber 15, various viscoelastic materials may be used. But, preferably, vulcanized rubbers such as NBR and IR; thermoplastic elastomers such nylon; thermoplastic elastomers such as styrene elastomers and polyurethane elastomers, comprising a hard segment and a soft segment bound to each other; and the like are used. Especially, a polymer alloy of two or more polymers mixed or chemically bonded is preferably used. For example, styrene-base thermoplastic elastomers available from Mitsubishi chemical corporation as product name Rabalon SJ4400N, SJ5400N, SJ6400N, SJ7400N, SJ8400N, SJ9400N, SR04 can be suitably used as the polymer alloy.

Preferably, the JIS-A-hardness of the vibration absorber 15 is not less than 40, more preferably not less than 50, but not more than 90, more preferably not more than 80. If the vibration absorber 15 is excessively hard, the vibration absorbing power decreases. If too soft on the other hand, it is difficult to secure the durability.

The shape of the vibration absorber 15 is not critical. Various shapes for example rectangular parallelepiped, circular cylinder, triangular prism, sphere, disc and the like can be employed, but a columnar shape is preferred. In this embodiment, employed is a columnar shape, in particular, rectangular parallelepiped of which central axis 15CL is substantially orthogonal to the club face F.

In the case of iron-type club heads, there are many opportunities to hit a ball lied on the lawn. Accordingly, there is a tendency that the ball is hit by a lower part of the club face F. Therefore, it is preferable that the vibration absorbers 15 are disposed at positions lower than the center of gravity G of the head. Thus, the vibration absorbers 15 are disposed on the lower frame 9*b*.

If the total volume of the vibration absorbers 15 is too small, it becomes difficult to obtain the advantageous result. If the total volume is too large, there is a possibility that the moment of inertia of the club head is undesirably decreased. In this light, the total volume of the vibration absorbers 15 is preferably not less than 350 cu.mm, more preferably not less than 370 cu.mm, still more preferably not less than 400 cu.mm, but not more than 700 cu.mm, more preferably not more than 680 cu.mm, still more preferably not more than 650 cu.mm.

When the ball hit off the sweet spot SS towards the toe, a relatively large moment is caused around the shaft axis, and transferred through the shaft to the player's hands as uncomfortable shock. Therefore, it is preferable that the vibration absorbers 15 are arranged in the heel-and-toe direction such that the vibration absorbers 15 include: at least one vibration absorber 15T whose gravity point is positioned on the toe-side of the vertical plane VP; and at least one vibration absorber 15H whose gravity point is positioned on the heel-side of the vertical plane VP. And the total volume of the toe-side absorber(s) 15T is set to be more than the total volume of the heel-side absorber(s) 15H.

In order to achieve this, for example, the vibration absorbers 15 having substantially same volume are arranged, and the number of the toe-side absorbers 15T (15T1 to 15T3) is set to be more than the number of the heel-side absorber(s) 15H.

Here, the vertical plane VP is a plane including the sweet spot SS and the center of gravity G of the head and being perpendicular to the club face F.

As explained above, it is desirable that a plurality of vibration absorbers 15 are disposed independently on the heel side and on the toe side. But, if the vibration absorbers 15 are too many, it is not preferable in view of not only the production efficiency and cost, but also the vibration absorbing power. Therefore, the number of the vibration absorbers 15 is preferably not less than 2, more preferably not less than 3, still more preferably not less than 4, but not more than 10, more preferably not more than 7, still more preferably not more than 5. in the case that all of the vibration absorbers 15 have substantially same volume, it is preferable that the difference of the number of the toe-side vibration absorbers 15T from the number of the heel-side vibration absorber(s) 15H is from 1 to 3.

In order to absorb the vibration of the face member 8 efficiently, the total contact area between the vibration absorbers 15 and the back surface 8*b* of the face member 8 is preferably not less than 40 sq.mm, more preferably not less than 50 sq.mm, still more preferably not less than 60 sq.mm. However, if the total contact area is too large, there is a possibility that the comfortable vibration on good shots is also absorbed. Therefore, the total contact area is preferably not more than 120 sq.mm, more preferably hot more than 110 sq.mm, still more preferably not more than 100 sq.mm.

Also the vibration absorber 15 contacts with the main frame 9, and transforms the vibration thereof at impact into heat. The above-mentioned recesses 21 can increase the contact area and helps to increase the vibration absorbing power. In this light, the depth B of the recesses 21 is preferably not less than 3.0 mm, more preferably not less than 4.0 mm, still more preferably not less than 5.0 mm, but not more than 10.0 mm, more preferably not more than 9.0 mm, still more preferably not more than 8.0 mm.

The vibration absorbers 15 are each provided with at least one cut SP.

The width Ws of the cut SP is not more than 1.0 mm, preferably not more than 0.7 mm, more preferably not more than 0.5 mm. The lower limit for the width Ws is 0 mm. If the width Ws is more than 1.0 mm, the mobility is excessively increased in the vicinity of the cut, and as a result, comfortable vibration on good shots is also absorbed and the impact feeling is blurred.

The cut SP can be formed at various positions. But, it is preferable that the cut line (e) contacts with the head main body 1A. Here, the cut line (e) is used to meant for a cut line having zero width as well as a certain opening width. In the case that the cut line (e) does not contact with the head main body 1A (for example, the cut SP is formed in the undermentioned free part 15*c*), even if the vibration is small, relatively large elasticity deformation is caused in the vicinity of the cut. As a result, there is a possibility that the comfortable vibration on good shots is also absorbed.

In this light, it is desirable that the total length L2 of a cut line (e) contacting with the head main body 1A is not less than 50%, more preferably not less than 80%, still more preferably 100% of the overall length of the cut line (e).

Here, the length of the cut line (e) is measured along the cut line. For example, in the case of FIG. 9, the overall length of the cut line (e) is the sum (La+Lb+Lc) of the lengths La, Lb and Lc.

If the total length L of the cut lines (e) of the cuts SP of the vibration absorbers 15 (namely, the total of the above-mentioned overall lengths of the cut lines per a head 1) is less than 10 mm, it becomes difficult to effectively absorb the vibration on miss shots. If the total length L is too long, there is a possibility that the comfortable vibration on good shots is also absorbed. Therefore, the total length L is preferably not less than 10 mm, more preferably not less than 20 mm, more preferably not less than 40 mm, but, not more than 160 mm, more preferably not more than 100 mm, still more preferably not more than 80 mm.

FIG. 9 shows an example of the vibration absorber 15. In this example, the shape of the vibration absorber 15 is a rectangular parallelepiped. A single flat planar cut SP is formed in parallel with the club face. In other words, the cut SP extends in the depthwise direction from a surface perpendicularly to the surface, while keeping the straight configuration of the cut line (e) at the surface. The cut SP is a full-open cut SP1 with both ends opened at both of the side surfaces of the vibration absorber 15.

FIG. 10 shows another example of the vibration absorber 15. In this example, the shape of the vibration absorber 15 is a rectangular parallelepiped. Three flat planar cuts SP are formed in parallel with the club face. In this example, two of the cuts SP are a semi-open cut SP2 whose one end is opened at a side surface of the vibration absorber 15, and the other end terminates in the vibration absorber 15. The remaining one cut SP is a closed cut SP3 whose both ends are terminated in the vibration absorber 15.

The above-mentioned three types of cuts SP1-SP3 may be freely used alone or in combination in one absorber 15. However, in view of the absorbing ability to the vibration on miss shots, preferably used is the semi-open cut SP2, more preferably the full-open cut SP1.

As to the cut plane 20 which means the plane extending along the widthwise center of the cut SP, when the cut plane 20 becomes parallel to the club face F, the vibration absorbing ability for the relatively low frequency, relatively large amplitude vibrations, is maximized. Therefore, the angle between the cut plane 20 and the club face F is not more than 60 degrees, preferably not more than 30 degrees, still more preferably not more than 10 degrees, most preferably substantially 0 degrees (namely, parallel).

What is important is to orient the cut plane 20 perpendicularly to the direction of the amplitude of the vibration to be absorbed. Accordingly, the orientation of the cut plane 20 may be changed or adjusted, depending on the position of the vibration absorber 15. Therefore, the vibration absorber 15 may be provided with a plurality of differently orientated cuts SP. For example, two cross cuts SP as shown in FIG. 11 may be provided.

FIG. 11 shows further example of the vibration absorber 15. In this example, the shape of the vibration absorber 15 is a rectangular parallelepiped. The front end 15*a* contacting with the back surface 8*b* and the rear end 15*b* contacting with the main frame 9 are each provided with two cross cuts SP.

If the depth D of the cut SP is too small, it is difficult to effectively absorb the vibration on miss shots. If the depth D is too large on the other hand, there is a possibility that the comfortable vibration on good shots is also absorbed. Therefore, the depth D of the cut SP is not less than 0.5 mm, preferably not less than 1.0 mm, but not more than 5 mm, preferably not more than 3 mm, more preferably not more than 2 mm. If the cut SP is opened at two or more surfaces of the vibration absorber, then the depth D is defined as being measured from the surface which has the longest cut line (e).

In the above-mentioned examples, the depth D of the cut SP is constant, but it may be variable. The cut line (e) is straight, but it may be of a zigzag or wavy configuration.

In FIG. 6 and FIG. 7 the rear part of each of the vibration absorbers 15 is inserted into the recesses 21, and the rear end 15*b* contacts with the bottom of the recesses 21. The recesses 21 is formed in the above-mentioned opposing surface 18*a* of the main frame 9.

In this embodiment, the front part of the vibration absorber 15 protrudes from the recesses 21. Therefore, this front part is a free part 15*c* extending to the face member through the space 13, without contacting with the head main body 1A.

Such free part 15*c* has higher mobility and increases the vibration absorbing power, thereby helps to downsize the vibration absorber.

If the size A of the free part 15*c* (namely, the distance between the back surface 8*b* and the first opposing surface 18*a*) is too small, the advantageous effect by the free part 15*c* is decreased. Therefore, the size A of the free part 15*c* is preferably not less than 0.3 mm, more preferably not less than 0.5 mm, still more preferably not less than 0.7 mm. However, if the size A of the free part 15*c* is too large, there is possibility that the desirable vibration on good shots is also absorbed. Therefore, the size A of the free part 15*c* is preferably not more than 4.0 mm, more preferably not more than 3.5 mm, still more preferably not more than 3.0 mm.

As explained above, the free part 15*c* or its free surface is not provided with the cut SP.

In FIG. 8 which shows a modification of the above-mentioned embodiment, in which the part having the opposing surface 18*a* is extended to the back surface 8*b*. As a result, the vibration absorbers 15 are completely contained in the recesses 21 of the head main body 1A, and the above-mentioned free part 15*c* is not formed.

Figure 12:
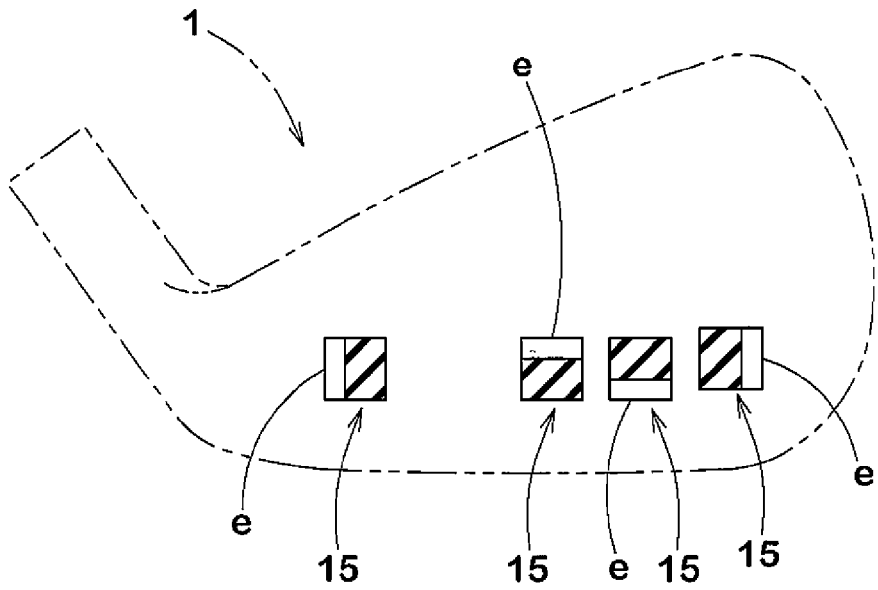
FIG. 12 is a diagram showing an arrangement of the vibration absorbers.

In this embodiment, as shown in FIG. 4, the longest cut lines (e) of the respective vibration absorbers 15 are oriented towards the upside. Another orientation pattern is of course possible. For example, as shown in FIG. 12, when the total number of the vibration absorbers 15 is not less than 4, the longest cut lines (e) of the vibration absorbers 15 can be oriented towards the toe, heel, upside and downside, respectively, wherein the most toe-side absorber is oriented towards the heel, and the most heel-side absorber is oriented towards the toe. As a result, the vibration absorbing ability of the vibration absorbers 15 in the mass may be improved.

Incidentally, the cut can be formed by cutting the material of the vibration absorber 15, using a cutting tool. Further, in the case of the vibration absorber 15 which is formed by the use of a mold, the cut can be formed by a blade attached to the mold.

As explained, the recess 21 is formed in the main frame 9. But, a recess into which a front part 15*a* of the vibration absorber 15 is inserted, can be formed on the face member 8, and such recess can be used instead of, or alternatively, together with the above-mentioned recess 21.

As to the manufacture of the club head 1, various methods can be employed. For example, the face member 8 is formed by press molding a rolled plate of the metal material. The main frame 9 is formed by casting the molten metal material. The vibration absorbers 15 are fitted into the recesses 21. The face member 8 and main frame 9 are assembled and fixed to each other by the use of one or more means of caulking, adhesive agent, screw cramp, press fitting, soldering, welding and the like. During assembling the face member 8 and main frame 9, it is important to control the compressibility ratio of the vibration absorber 15 in the back-and-forth direction under 20%, preferably under 10% in order to retain the viscoelasticity.

Comparison Tests

Iron club heads (loft 24 deg.) were made, using the identical main frames and the identical face members shown in FIGS. 1-2 and 6-7. The main frame was formed by lost-wax precision casting of SUS630, and the face member was formed by press molding of Ti-6Al-4V. The main frame was provided with four recesses 21 each having a depth (B) of 5 mm and a square sectional shape (6 mm×6 mm). The face member was fixed to the main frame by means of caulking and an adhesive agent. The vibration absorber was formed by injection molding of a styrene-base thermoplastic elastomer available from Mitsubishi chemical corporation as product name Rabalon SR04.

Figure 13:
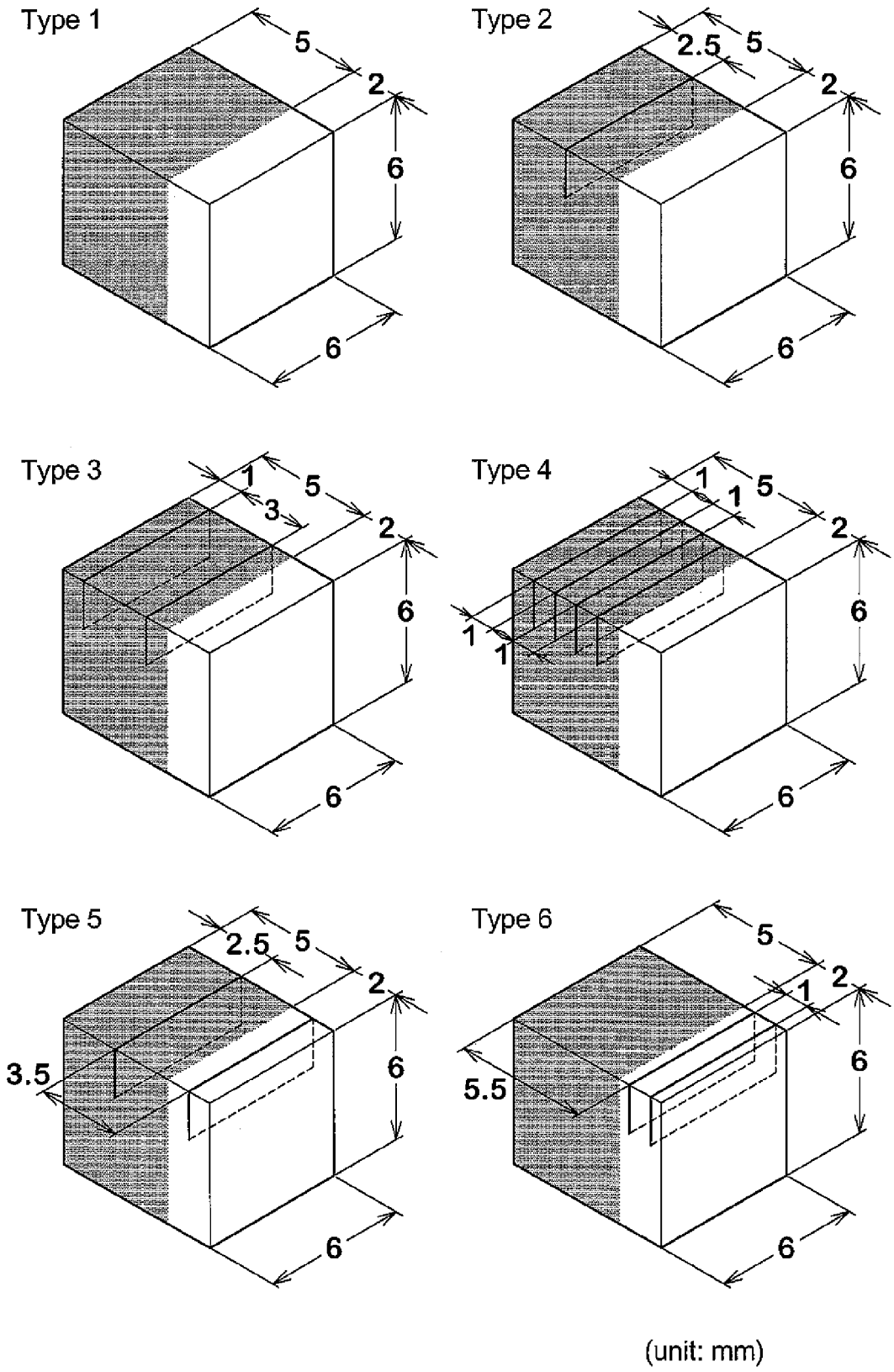
FIG. 13 shows six types of vibration absorbers used in the undermentioned comparison test, wherein numerals accompanied by leader lines with arrowheads indicate sizes in millimeter.

The common specifications of the absorbers are as follows:

sectional shape: square (6 mm×6 mm)
Size (A) of the free part: 2 mm
Length (=A+B): 7 mm
Cut depth D: 2 mm The club heads were each provided with four absorbers as shown in Table 1 and FIG. 13. All of the cut planes were parallel with the club face, and all of the longest cut lines (e) were oriented towards the upside. In FIG. 13, the shadowed part indicates the part inserted into the recess 21.

Impact feeling test: The heads were attached to identical carbon shafts ("MP-200", flex R, manufactured by SRI sports Limited) and 38-inch iron clubs were prepared. With each club, ten golfers hit three-piece balls ("Z-UR" manufactured by SRI Sports Limited), and the impact feeling when the ball hit the sweet area was evaluated into five ranks as follows based on Ref. 1 being rank 3 (standard). Rank 1 (bad, unsolid impact feeling)→Rank 5 (good, solid impact feeling) Further, the impact feeling when the ball hit off the sweet spot was evaluated into five ranks based on Ref. 1 being rank 3 (standard). Rank 1 (bad, large shock)→Rank 5 (good, small shock)

The mean value of the rank numbers of ten golfers is shown in Table 1.

From the test results, it was confirmed that the unpleasant vibration on miss shots can be reduced, while maintaining the comfortable vibration on good shots, and good impact feeling can be obtained.

The present invention suitably applied to iron-type golf club heads as above, but it is also possible to apply the invention to another type of golf club head such as patter-type, utility-type and wood-type.

The invention claimed is:

1. A golf club head comprising:

a head main body comprising a face member made of a metal material and having a back surface and a front surface forming a major part of a club face for striking a ball and a main frame made of a metal material for supporting the face member; and a plurality of vibration absorbers made of a viscoelastic material and attached to the head main body, wherein said main frame comprises a rear wall spaced apart form said back surface of the face member, each said vibration absorber is disposed between the rear wall and said back surface so that the front end of the vibration absorber comes into contact with said back surface of the face member, said rear wall is provided with a plurality of recesses into which the vibration absorbers are respectively inserted, the surface of each said recess contacts with the inserted part of the vibration absorber, each said vibration absorber is provided in the surface contacting with the head main body with at least one cut having a width of not more than 1.0 mm so that the entire length of the cut line of the cut contacts with the head main body, and the total length of the cut lines of the cuts of the vibration absorbers is not less than 10 mm but not more than 160 mm.

2. The head according to claim 1, wherein a cut plane of the cut is substantially parallel with the club face.

3. The head according to claim 1, wherein each of the vibration absorbers protrudes from the recess so as to form a free part not provided with any cut and extending in the space between the back surface and the rear wall without contacting with the head main body.

TABLE 1

| Head | Ref. 1 | Ex. 1 | Ex. 2 | Ex. 3 | Ref. 2 | Ex. 4 | Ex. 5 | Ex. 6 | Ex. 7 | Ex. 8 | Ex. 9 | Ex. 10 | Ex. 11 |
|---|---|---|---|---|---|---|---|---|---|---|---|---|---|
| Vibration absorber | | | | | | | | | | | | | |
| (Type) × number | (1) × 4 | (2) × 4 | (2) × 4 | (2) × 4 | (2) × 4 | (2) × 4 | (2) × 4 | (2) × 1<br>(1) × 3 | (2) × 2<br>(1) × 2 | (3) × 4 | (4) × 4 | (6) × 4 | (7) × 4 |
| Length L (mm) | 0 | 40 | 40 | 40 | 40 | 28 | 32 | 10 | 20 | 80 | 160 | 40 | 40 |
| Length L2 (mm) | 0 | 40 | 40 | 40 | 40 | 28 | 32 | 10 | 20 | 80 | 160 | 20 | 0 |
| L2/L | — | 1 | 1 | 1 | 1 | 1 | 1 | 1 | 1 | 1 | 1 | 0.5 | 0 |
| Width Ws (mm) | — | 0 | 0.5 | 1 | 1.5 | 0 | 0 | 0 | 0 | 0 | 0 | 0 | 0 |
| Depth D (mm) | — | 2 | 2 | 2 | 2 | 0.5 | 1 | 2 | 2 | 2 | 2 | 2 | 2 |
| Impact feeling | | | | | | | | | | | | | |
| on miss shots | 3.0 | 4.3 | 4.5 | 4.4 | 4.6 | 3.3 | 4.0 | 3.4 | 3.9 | 4.5 | 4.5 | 4.1 | 3.5 |
| on good shots | 3.0 | 3.0 | 3.0 | 2.8 | 2.2 | 3.0 | 3.0 | 3.0 | 3.0 | 2.9 | 2.7 | 3.0 | 2.8 |

4. The head according to claim 1, wherein the total contact area between the vibration absorbers and the back surface of the face member is not less than 40 sq.mm.

5. The head according to claim 4, wherein the total volume of the vibration absorbers is not less than 350 cu.mm, but not more than 700 cu.mm.

6. The head according to claim 1, wherein the recesses each have a depth of not less than 3.0 mm but not more than 10.0 mm.

* * * * *